US005152466A

United States Patent [19]

Matushita et al.

[11] Patent Number: 5,152,466

[45] Date of Patent: Oct. 6, 1992

[54] ELECTROSTATIC COATING APPARATUS FOR CONDUCTIVE PAINT

[75] Inventors: Masaharu Matushita, Nagoya; Noriyuki Achiwa, Toyota; Touichi Watanabe, Yokohama; Masachika Kanematsu, Nagoya, all of Japan

[73] Assignee: Trinity Industrial Corporation, Tokyo, Japan

[21] Appl. No.: 634,567

[22] Filed: Dec. 27, 1990

[30] Foreign Application Priority Data

Dec. 27, 1989 [JP] Japan ..... 1-336632

[51] Int. Cl.[5] ..... B05B 5/02

[52] U.S. Cl. ..... 239/690; 239/708; 118/629; 361/228

[58] Field of Search ..... 239/690, 691, 3, 704, 239/708; 361/227, 228; 118/629

[56] References Cited

U.S. PATENT DOCUMENTS

| | | | |
|---|---|---|---|
| 4,878,622 | 11/1989 | Jamison et al. | 239/690.1 |
| 4,879,137 | 11/1989 | Behr et al. | 239/3 |
| 4,921,169 | 5/1990 | Tilly | 239/690 |
| 4,962,724 | 10/1990 | Prus et al. | 239/708 |
| 5,014,645 | 5/1991 | Cann et al. | 239/708 |

FOREIGN PATENT DOCUMENTS 8705832 10/1987 PCT Int'l Appl. ..... 239/690

*Primary Examiner*—Andres Kashnikow
*Assistant Examiner*—Christopher G. Trainor
*Attorney, Agent, or Firm*—Cushman, Darby & Cushman

[57] ABSTRACT

An electrostatic coating apparatus for coating an electroconductive paint includes an electrostatic coating machine applied with a high voltage, a paint supply pipeline for supplying an electroconductive paint and a reciprocal pump disposed between the electrostatic coating machine and the paint supply pipeline and adapted such that the paint introduced from the input port is discharged at a predetermined flow rate from the output port of the pump and supplied at a predetermined amount to the electrostatic coating machine. The input port of the pump is made detachable from the paint supply pipeline. Electric insulation to paint supply pipelines can be saved. The reciprocal pump may be replaced with a paint charge pipe connected with a cleaning liquid supply pipe for supplying a cleaning liquid at a predetermined flow rate, thereby discharging the paint from the paint charge pipe.

2 Claims, 4 Drawing Sheets

ELECTROSTATIC COATING APPARATUS FOR CONDUCTIVE PAINT

BACKGROUND OF THE INVENTION

1. Field of the Invention

The present invention concerns an electrostatic coating apparatus used for coating an electroconductive paint such as an aqueous paint, a slurry paint or a metallic paint by using an electrostatic coating apparatus applied with a high voltage.

2. Description of the Prior Art

When an electroconductive paint such as an aqueous paint is used in an electrostatic coating machine applied with a high voltage, it is necessary to electrically insulate paint supply systems from the electrostatic coating machine for preventing current leakage caused by the high voltage. Accordingly, in a multi-color electrostatic coating apparatus used for coating car bodies under color-change of paints of so many different colors, which may include several tens of tones, insulation means have to be applied to all of paint supply pipelines or paint reservoirs on every color of paint, which has been troublesome and expensive.

In view of the above, in the electrostatic coating for car bodies, manufactures such as automobile manufacturers hesitate to use aqueous paints at present, although aqueous paints may be preferable for use, because they cause less pollution of air, because they contain less volatile organic compounds than do organic solvent-based coating compositions. Instead, electrically insulative resin paints that require a great amount of deleterious organic solvents continue to be used predominantly.

However, social movements for environmental protection have been raised world-world in recent years and it has been advocated to more stringently regulate and thereby restrict the use of organic solvents that release environmental pollutants such as hydrocarbons also in the field of coating industry.

SUMMARY OF THE INVENTION

It is, accordingly, an object of the present invention to provide a technique capable of saving troublesome installation for insulation means to paint supply systems such as pipelines for supplying a conductive paint, for example, an aqueous paint or paint reservoirs in a case where electrostatic coating is applied by using an electrostatic coating machine operated under a high voltage.

The foregoing object of the present invention can be attained by an electrostatic coating apparatus for coating an electroconductive paint comprising an electrostatic coating machine applied with a high voltage, a paint supply pipeline for supplying an electroconductive paint and a reciprocal pump disposed between the electrostatic coating machine and the paint supply pipeline and adapted such that the electroconductive paint introduced from the input port is discharged at a predetermined flow rate from the output port of the reciprocal pump and supplied at a predetermined amount to the electrostatic coating machine. The input port of the reciprocal pump is detachably connected to the paint supply pipeline In the apparatus of the present invention, the paint supply pipeline is connected to the input port of the reciprocal pump and the conductive paint is introduced from the paint supply pipeline to the inside of the reciprocal pump before starting a coating operation in a state where a high voltage is not yet applied to the electrostatic coating machine. Subsequently, when a predetermined amount of the coating paint is filled in the reciprocal pump, the paint supply pipeline is detached from the input port of the reciprocal pump.

Coating is started with a predetermined high voltage being applied to the electrostatic coating machine, and the conductive paint filled in the reciprocal pump is discharged at a predetermined flow rate from the output port and supplied at a constant amount to the electrostatic coating machine.

In this state, since the electrostatic coating machine and the paint supply pipeline are separated and electrically insulated from each other, the high voltage applied to the electrostatic coating machine does not leak to the paint supply systems such as the paint supply pipeline and the paint reservoir.

Accordingly, troublesome installation of insulation means to the paint supply systems is not necessary.

The object of the present invention can also be attained by an electrostatic coating apparatus for coating an electroconductive paint comprising an electrostatic coating machine applied with a high voltage, a paint charge pipe connected to the electrostatic coating machine and capable of charging a required amount of an electroconductive paint, a paint supply pipeline detachably connected with the paint charge pipe for charging the electroconductive paint into the paint charge pipe, a cleaning liquid supply pipeline connected to the paint supply pipeline for supplying a cleaning liquid and, in turn, discharging the electroconductive paint filled in the paint charge pipe at a predetermined flow rate in accordance with the amount of the paint discharged from the electrostatic coating machine and a cleaning liquid reservoir disposed in an electrically insulated state for supplying the cleaning liquid to the paint supply pipeline.

In this modified apparatus, the reciprocal pump used in the above-mentioned apparatus is replaced with the paint charge pipe and the electroconductive paint charged in the pipe is forced out by the cleaning liquid supplied at a predetermined amount to the electrostatic coating machine for cleaning the inside of the electrostatic coating machine. After completion of the coating, since the inside of the paint charge pipe connected to the electrostatic coating machine has already been cleaned, there is no further requirement for cleaning the inside and the cleaning time can be shortened.

If the cleaning liquid supply pipe is detachably connected to the paint charge pipe like that in the paint supply pipe, there is no requirement for electrically insulating the cleaning liquid reservoir.

BRIEF DESCRIPTION OF THE DRAWINGS

These and other objects, as well as advantageous features of the present invention will become apparent by reading the following descriptions of the preferred embodiments according to the present invention with reference to the appended drawings, wherein.

DESCRIPTION OF THE PREFERRED EMBODIMENTS OF THE INVENTION

The present invention will now be described by way of its preferred embodiments with reference to the drawings.

Structure of the First Embodiment

Figure 1:
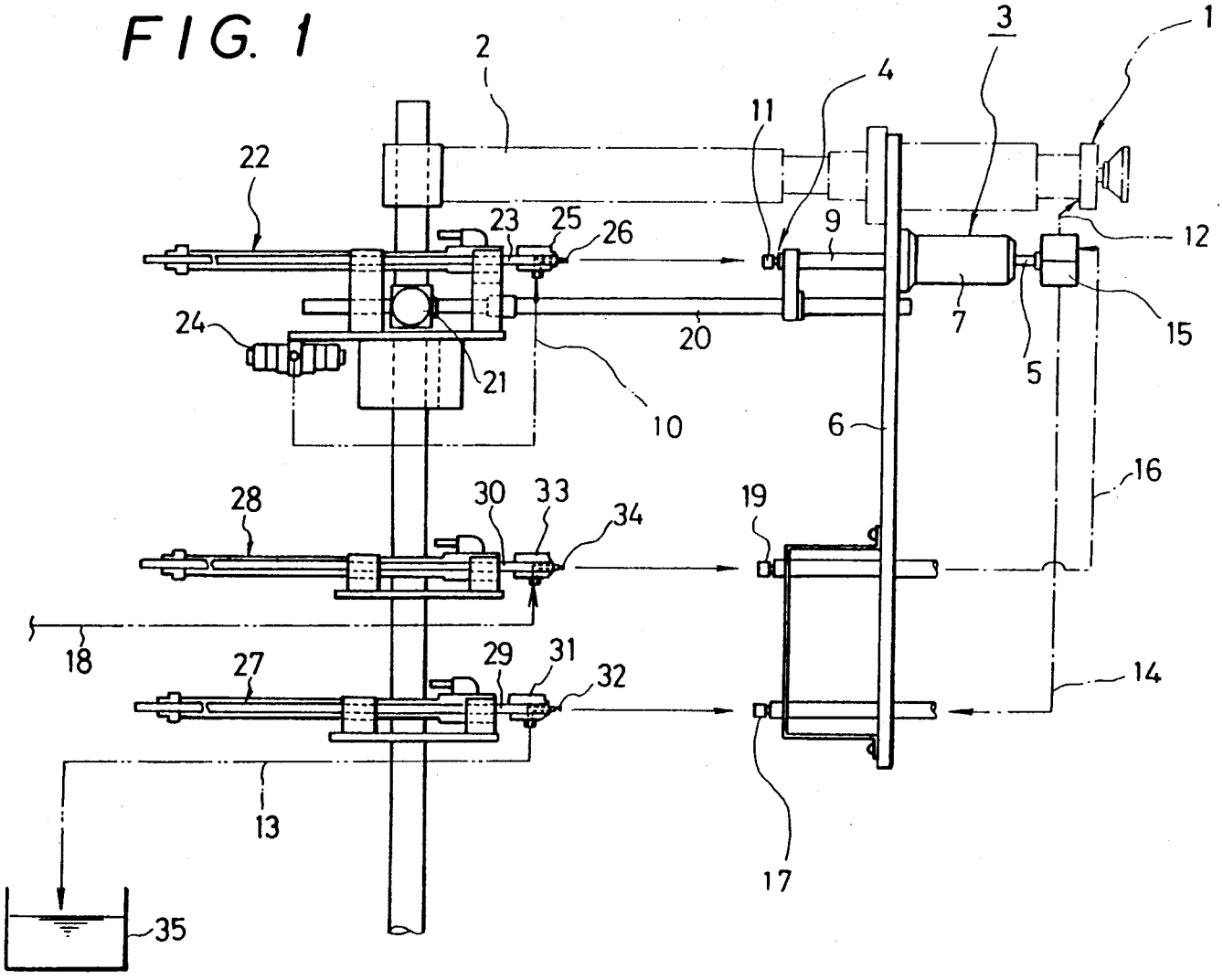
FIG. 1 is a front elevational view illustrating a preferred embodiment of an electrostatic coating apparatus according to the present invention.
Figure 2:
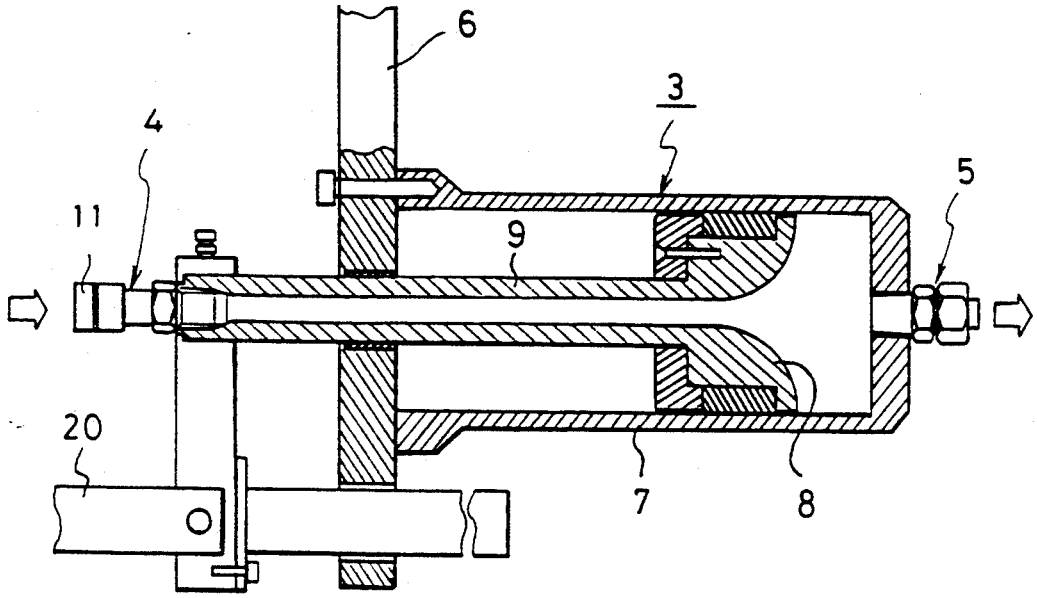
FIG. 2 is a cross-sectional view for a reciprocal pump used in the apparatus shown in FIG. 1.

FIG. 1 is a front elevational view illustrating a preferred embodiment of the electrostatic coating apparatus according to the present invention and FIG. 2 is a cross-sectional view for a reciprocal pump used in the apparatus.

In this first embodiment, an electrostatic coating machine 1 applied with a high DC voltage of about 80–120 KV is supported on an electrically insulative support 2. In adjacency with the electrostatic coating machine 1, a reciprocal pump 3 is disposed, in which an electroconductive paint such as an aqueous paint (hereinafter simply referred to as a conductive paint) is introduced from an input port 4 and discharged from an output port 5 at a predetermined flow rate.

The reciprocal pump 3 is fixed in an electrically insulated state, to a bracket 6 attached to a housing for the electrostatic coating machine. The reciprocal pump 3 comprises a cylinder 7 having the output port 5 disposed on its top end, and a tubular piston rod 9 having an annular piston 8 disposed on its top end and the input port 4 disposed at its rear end, with the top end of the piston rod 9 being opened in the cylinder 7.

The input port 4 has a female coupler 11 formed at its connection port for detachably connecting a paint supply pipe 10 for a conductive paint.

The output port 5 has a valve device 15 that switchingly connects the output port 5 to a paint hose 12 for supplying the conductive paint discharged from the inside of the cylinder 7 by the piston 8 of the reciprocal pump 3 to the electrostatic coating machine 1, or to a drain pipe 14 for draining the conductive paint remaining in the cylinder 7 to a liquid waste pipe 13 after the completion of the coating by means of cleaning air or cleaning liquid supplied from the paint supply pipe 10.

The valve device 15 is adapted such that a pipe 16 used exclusively for cleaning is connected with the paint hose 12 when the output port 5 is connected with the drain pipe 14.

The drain pipe 14 and the cleaning pipe 16 are secured to the bracket 6 one above the other and in parallel with the piston rod 9 of the reciprocal pump 3. The top ends of the pipes 14 and 16 have a female coupler 17 as a connection port for detachably connecting the liquid waste pipe 13 and a female coupler 19 as a connection port for detachably connecting a cleaning liquid supply pipe 18 respectively for alternately supplying a cleaning air at low pressure and a cleaning liquid at low pressure.

Behind the cylinder 7 of the reciprocal pump 3, there are disposed a driving device 21 that transmits a reciprocal driving power to the piston rod 9 of the cylinder 7 by way of an insulative shaft 20, and a double-action-type air cylinder 22 that advances and retracts the top end of its piston rod 23 to and from the rear end of the piston rod 9.

The piston rod 23 has a holder 25 formed at its top end for holding the end of the paint supply pipe 10 for selectively supplying an aqueous paint of each of a plurality of colors, or cleaning air at a high pressure and a cleaning liquid at a high pressure from a color-change valve device 24. The holder 25 has a male coupler 26 that engages or disengages to or from the female coupler 11 disposed on the input port 4 in order to detachably connect the paint supply pipe 10 with the input port 4 of the reciprocal pump 3.

Air cylinders 27 and 28 each of an identical type are disposed in parallel with the air cylinder 22 for advancing and retracting the top ends of their piston rods 29 and 30 to and from the female coupler 17 as a connection port on the side of the drain pipe 14 and the female coupler 19 as the connection port on the side of the exclusive cleaning pipe 16, respectively.

The air cylinder 27 has a holder 31 disposed on its piston rod 29, for holding the end of the liquid waste pipe 13. A male coupler 32 is disposed on the holder 31, for engaging and disengaging the liquid waste pipe 13 to and from the drain pipe 14.

The air cylinder 28 has a holder 33 disposed on its piston rod 30, for holding the end of the cleaning liquid supply pipe 18. A male coupler 34 is disposed on the holder 33, for engaging and disengaging the cleaning liquid supply pipe 18 to and from the exclusive cleaning pipe 16.

Operation of the First Embodiment

The operation of the apparatus of this embodiment, thus constituted, will be explained below.

Before starting an electrostatic coating operation, the driving device 21 is at first actuated to extend the piston rod 9 toward the rear of the cylinder 7 in the reciprocal pump 3. Then, the air cylinder 22 is actuated to extend the piston rod 23 toward the piston rod 9 and engage the male coupler 26 disposed at the top end of the piston rod 23 with the female coupler 11 disposed at the rear end of the piston rod 9, to thereby connect the paint supply pipe 10 to the input port 4 of the reciprocal pump 3.

Then, an aqueous paint of a desired color is selected, by operating the color-change valve device 24, and the aqueous paint thus selected is introduced from the paint supply pipe 10 through the inlet port 4 into the cylinder 7 of the reciprocal pump 3.

When a predetermined amount of the aqueous paint has been charged into the cylinder 7, the air cylinder 22 is actuated again to contract the piston rod 23 in the direction aparting from the piston rod 9 of the cylinder 7, thereby detaching the male coupler 26 of the piston rod 23 from the female coupler 11 on the side of the input port 4.

The female coupler 11 has a structure like that of a check valve, i.e., opening the connection port on the side of the input port 4 when it engages the male coupler 26, while closing the connection port when it disengages from the male coupler 26. After detaching the paint supply pipe 10 from the reciprocal pump 3, a predetermined high voltage is applied to the electrostatic coating machine 1. At the same time, the driving device 21 is actuated to contract the piston rod 9 of the cylinder 7 and drive the aqueous paint charged in the cylinder 7 out of the output port 5 by the piston 8 disposed at the top end of the piston rod 9 and supply it through the paint hose 12 to the electrostatic coating machine 1, thereby starting the electrostatic coating.

In this state, since the electrostatic coating machine 1 is separated and electrically insulated from the paint supply systems including the paint supply pipe 10, the liquid waste pipe 13 and the cleaning liquid supply pipe 18, there is no worry at all that the high voltage applied to the electrostatic coating machine 1 could cause current leakage to the latter.

Accordingly, troublesome installation of electrical insulation means to all of the paint supply systems in a multi-colored electrostatic coating apparatus for supplying aqueous paints of respective colors is not required.

When the electrostatic coating has been completed after discharging the aqueous paint from the inside of the cylinder 7, application of the high voltage to the electrostatic coating machine 1 is interrupted and the driving device 21 is actuated to extend the piston rod 9 of the cylinder 7 rearwardly. At the same time, the air cylinder 22 is actuated to extend the piston rod 23, and the female coupler 11 disposed on the rear end of the piston rod 9 is engaged with the male coupler 26 disposed at the top end of the piston rod 23 to connect the paint supply pipe 10 again to the input port 4 of the reciprocal pump 3.

In a case of successively coating the aqueous paint of a color identical with that in the preceding coating process, the aqueous paint of that color is again supplied from the color-change valve device 24.

In the case of coating an aqueous paint of a color different from that in the preceding coating process, the output port 5 of the reciprocal pump 3 is connected switchingly from the side of the paint hose 12 to the side of the drain pipe 14 by the operation of the valve device 15 and, at the same time, the paint hose 12 is connected switchingly to the exclusive cleaning pipe 16.

Further, the air cylinders 27 and 28 are actuated to extend the respective piston rods 20 and 30 and engage the male couplers 32 and 34 formed on the top ends thereof, with the female coupler 17 on the side of the drain pipe 14 and the female coupler 19 on the side of the excluding cleaning pipe 16 respectively, thereby connecting the liquid waste pipe 13 with the drain pipe 14 and connecting the cleaning liquid supply pipe 18 with the exclusive cleaning pipe 16.

In this state, cleaning air at a high pressure and a cleaning liquid at a high pressure are supplied alternately from the color-change valve device 24 through the paint supply pipe 10 to instantaneously drain the aqueous paint remaining in the cylinder 7 of the reciprocal pump 3 from the drain pipe 14 through the liquid waste pipe 13 to the liquid waste reservoir 35, to clean the inside of the paint supply pipe 10 and the inside of the cylinder 7. At the same time, the aqueous paint remaining in the paint hose 12 or the electrostatic coating machine 1 is discharged from the coating machine 1 by the cleaning air at a low pressure and by the cleaning liquid at a low pressure alternately supplied from the cleaning liquid supply pipe 18 through the exclusive cleaning pipe 16, to clean the inside of the hose 12 and machine 1.

In this way, the paint remaining in the cylinder 7 of the reciprocal pump 3 of a large volume is removed by cleaning with the cleaning air and the cleaning liquid each supplied at a high pressure, while the paint remaining in the electrostatic coating machine 1 of a relatively small volume is removed by cleaning with the cleaning air and the cleaning liquid each supplied at a low pressure. Accordingly, the cleaning time can be shortened remarkably and color-change of paint can be conducted rapidly. In addition, vigorous scattering of the paint removed from the inside of the electrostatic coating machine 1 which would otherwise occur and contaminate the periphery of the apparatus can be eliminated.

Structure of the Second Embodiment

Figure 3:
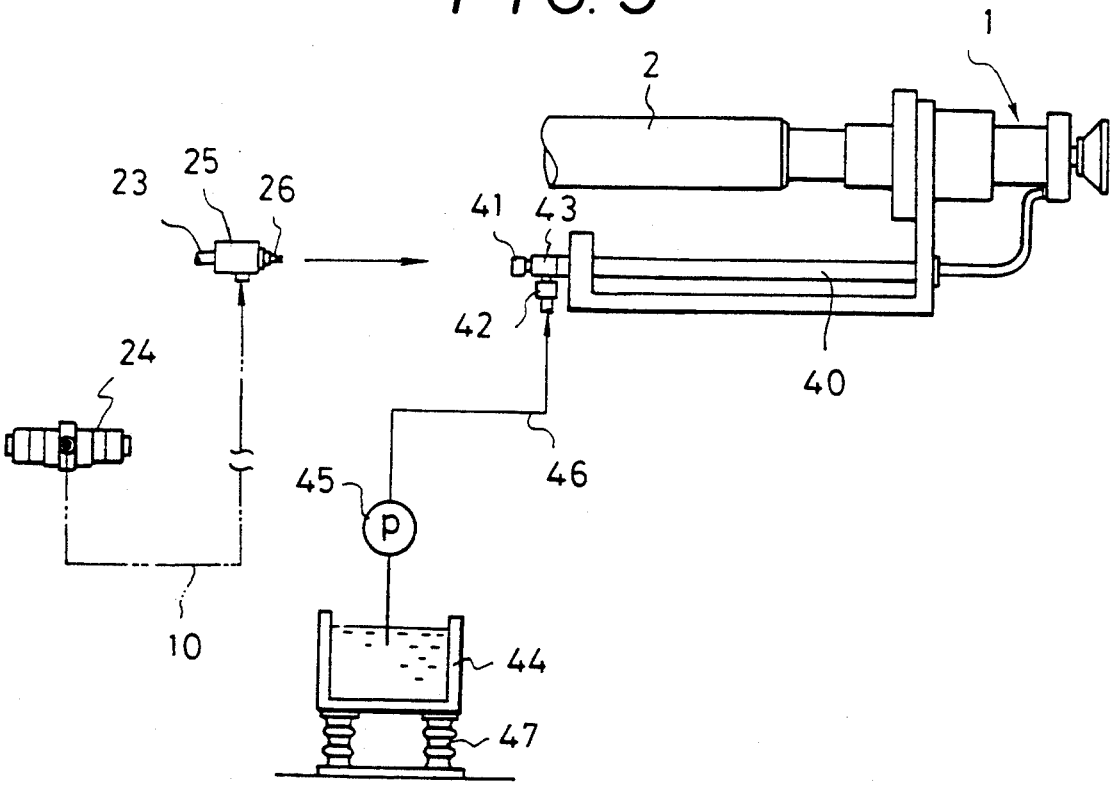
FIG. 3 is a front elevational view illustrating another embodiment of the electrostatic coating apparatus according to the present invention.

FIG. 3 shows a front elevational view illustrating another embodiment of the electrostatic coating apparatus according to the present invention.

In this embodiment, a paint charge pipe 40 is used instead of the reciprocal pump 3 of the previous embodiment shown in FIGS. 1 and 2, and the conductive paint charged in the pipe 40 is driven out by cleaning liquid.

The paint charge pipe 40 capable of containing a required amount of a conductive paint is connected to an electrostatic coating machine 1 to be applied with a high voltage and the pipe 40 has a female coupler 41 and a connector 42 formed at its rear end, in which flow channels for both of them are switched alternately by a valve 43.

The paint supply pipe 10 and the paint charge pipe 40 are so adapted that they are detachably connected by engaging and disengaging the male coupler 26 disposed at the top end of the piston rod 23 shown in FIG. 1 to and from the female coupler 41 disposed on the rear end of the paint charge pipe 40.

A cleaning liquid supply pipe 46 is communicated to the connector 42 by way of a gear pump 45 for supplying a cleaning liquid stored in a cleaning liquid reservoir 44 at a predetermined flow rate to the inside of the paint charge pipe 40 in accordance with the amount of the paint charge pipe 40 in accordance with the amount of the paint discharged from the electrostatic coating machine.

The cleaning liquid reservoir 44 is supported on an electrically insulative ceramic insulator 47.

Operation of the Second Embodiment

At first, the paint supply pipe 10 is connected to the paint charge pipe 40 and the conductive paint is supplied to the inside of the pipe 40.

When a predetermined amount of the paint has been charged in the paint charge pipe 40, the paint supply pipe 10 is disconnected from the pipe 40 and, subsequently, a predetermined high voltage is applied to the electrostatic coating machine 1.

In this state, the valve 43 is switched to close the flow channel on the side of the female coupler 41 and opens the flow channel on the side of the connector 42. At the same time, the gear pump 45 disposed at the midpoint of the cleaning liquid supply pipe 46 is actuated to supply the cleaning liquid in the cleaning liquid reservoir 44 into the paint charge pipe 40 at a predetermined flow rate in accordance with the amount of the paint discharged from the electrostatic coating machine 1.

Thus, the conductive paint charged in the paint discharge pipe 40 is driven out at the predetermined flow rate in accordance with the flow rate of the cleaning liquid supplied into the pipe 40 and then supplied to the electrostatic coating machine 1.

In this embodiment, since the inside of the paint charge pipe 40 has already been cleaned upon completion of the coating, it is possible to shorten the cleaning time and to conduct rapid color-change.

Further, since the electrostatic coating can be conducted in a state in which the electrostatic coating machine 1 applied with the high voltage is electrically insulated from the paint supply pipe 10 also in this embodiment, installation of electric insulation means to the paint supply systems for the conductive paint is not required but the insulation means may be disposed only to the cleaning liquid supply system consisting of the cleaning liquid reservoir 44 and the cleaning liquid supply pipe 46.

As a further modified embodiment, if a female coupler is disposed instead of the connector 42 and a male coupler is disposed on the top end of the cleaning liquid supply pipe 46, so that the cleaning liquid supply pipe 46 is detachably connected to the paint charge pipe 40 in the same manner as in the paint supply 10, application of the insulation means to the cleaning liquid supply system can be saved.

Structure of the Third Embodiment

Figure 4:
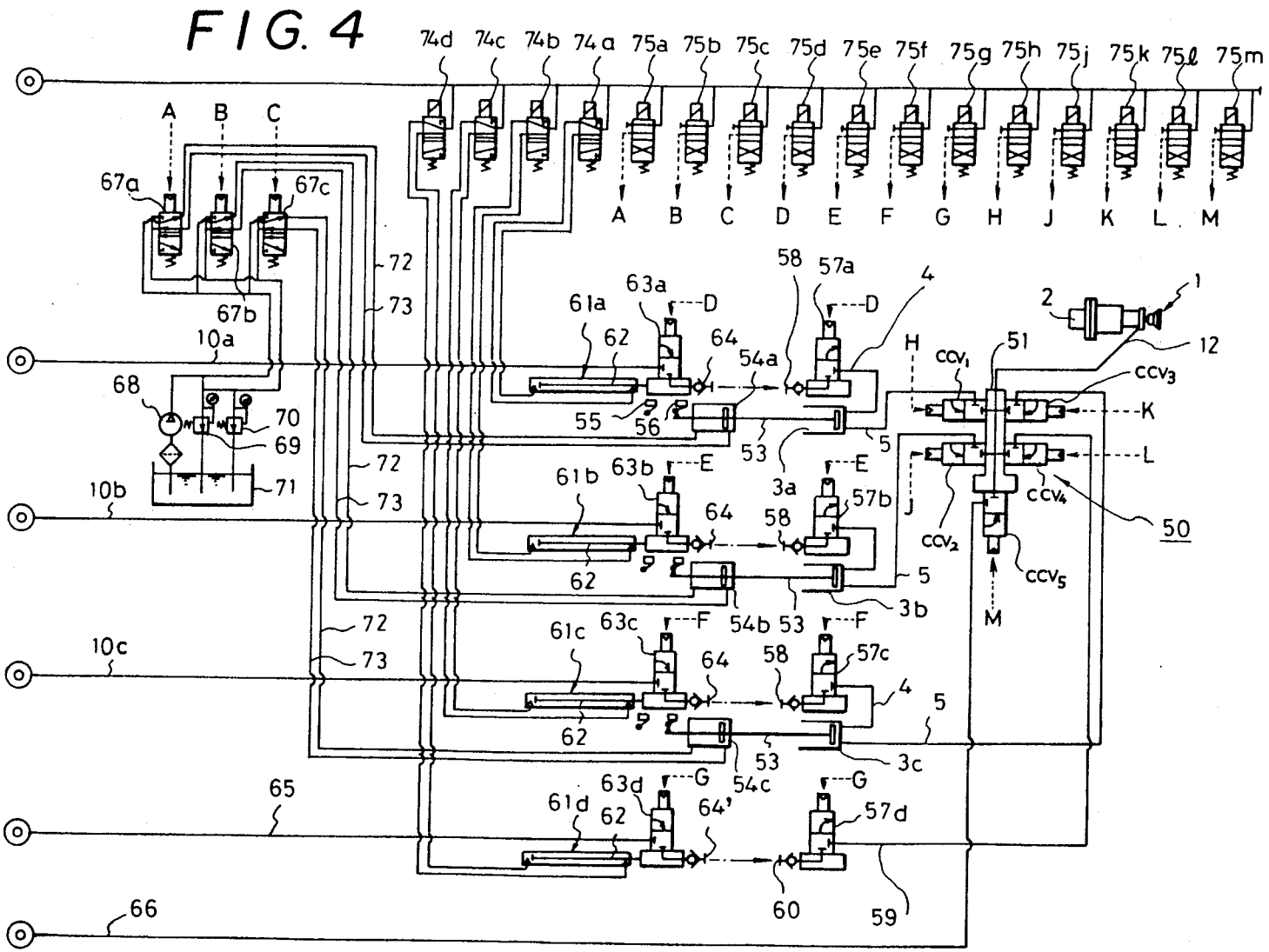
FIG. 4 schematically illustrates a still further embodiment of the electrostatic coating apparatus according to the present invention and FIGS. 5 and 6 are, respectively, a front elevational view and a top plan view illustrating detailed structures for a portion of the apparatus shown in FIG. 4.
Figure 5:
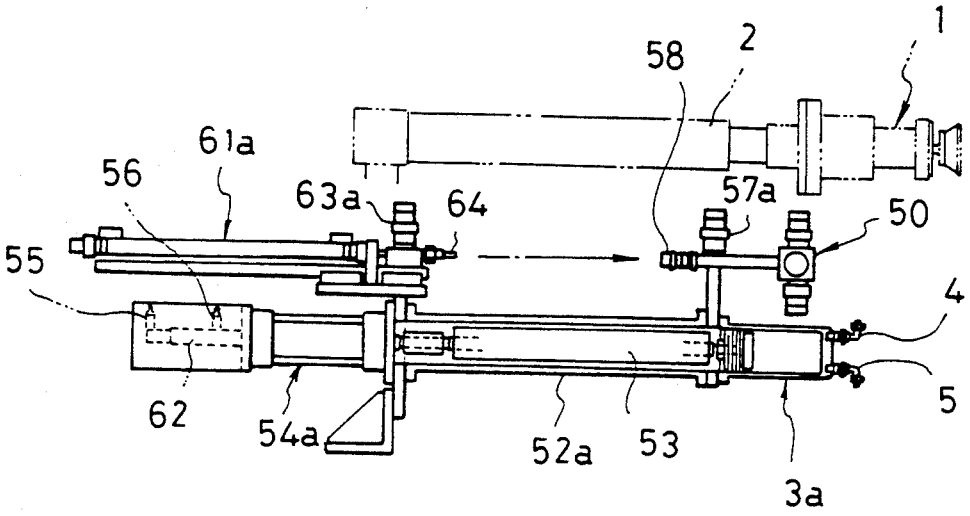
Figure 6:
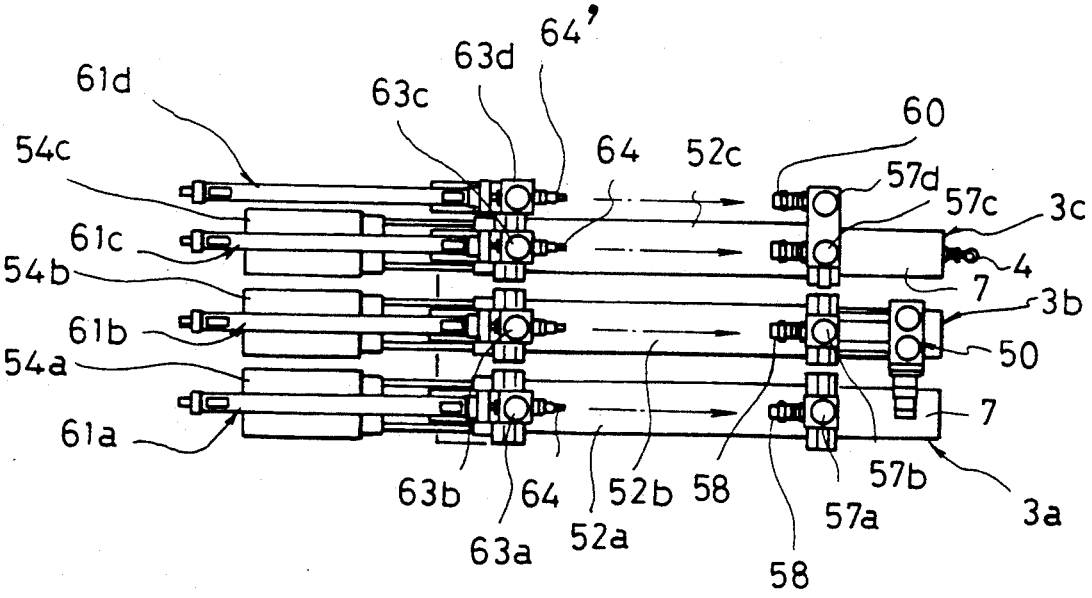

FIG. 4 is a flow sheet illustrating a further embodiment of the electrostatic coating apparatus according to the present invention, and FIGS. 5 and 6 are, respectively, a front elevational view and a plan view illustrating a detailed construction for each of them.

In the third embodiment, an electrostatic coating machine 1 is connected by way of a paint hose 12 with a manifold 51 of a color-change valve device 50 having a plurality of color-change valves $CCV_1$–$CCV_5$.

Tubular insulative supports 52*a*–52*c* are arranged in parallel with the insulative support 2 for the electrostatic coating machine 1, each of the cylinders 7 for the reciprocal pumps 3*a*–3*c* is attached to each of the ends of the supports, each of insulative shafts 53 serves as a piston rod for each of the cylinders 7 and is inserted through the inside of each support, and each of hydraulic cylinders 54*a*–54*c* for reciprocating each of the insulative shafts 53 is attached to the rear end of each shaft. Proximity switches 55 and 56 are disposed for outputting start/stop signals for each of the hydraulic cylinders 54*a*–54*c*.

Further, air valves 57*a*–57*c* which are turned on and off by air signals are attached to the top end of the insulative supports 52*a*–52*c* respectively. Each of the valves is connected at its exit to the input port 4 for each of the cylinders 7 for the reciprocal pumps 3*a*–3*c* and has a female coupler 58 disposed at its inlet as a connection port on the side of the input port 4.

The output port 5 for each of the cylinders 7 of the reciprocal pumps 3*a*–3*c* is connected to each of the color-change valves $CCV_1$–$CCV_3$ of the color-change valve device 50 disposed in an electrically insulated state.

An air valve 57*d*, which is turned on and off by air signals, is attached at the top end of the insulative support 52*c* in adjacent with the air valve 57*c*. The valve 57*d* is connected at its exit by way of an exclusive cleaning pipe 59, to the color-change valve $CCV_4$ and has a female coupler disposed at its inlet as a connection port on the side of the exclusive cleaning pipe 59.

Double-action type cylinders 61*a*–61*d* are disposed at the rear ends of the insulative supports 52*a*–52*c*, respectively, and air valves 63*a*–63*d* which are turned on and off by air signals are disposed on the top ends of the piston rods 62, respectively. Each of the air valves 63*a*–63*c* is connected at its inlet with each of paint supply pipes 10*a*–10*c* for supplying conductive paint of respective colors and has a male coupler 64 connected at its exit, to be detachably connected to a female coupler 58 as a connection port on the side of the input port 4 for each of the reciprocal pumps 3*a*–3*c*.

Further, the air valve 63*d* has a cleaning liquid supply pipe 65 connected at its inlet for supplying a cleaning liquid, and a male coupler 64' connected at its exit, to be detachably connected with a female coupler 60 as a connection port on the side of the exclusive cleaning pipe 59.

A cleaning air supply pipe 66 is directly connected with the color-change valve $CCV_5$.

Switching valves 67*a*–67*c* are disposed for supplying a hydraulic fluid or oil to a hydraulically operated cylinders 54*a*–54*c* and so adapted that they send a hydraulic fluid in a hydraulic fluid reservoir 71 to each of the hydraulic cylinders 54*a*–54*c* through each pair of pipes 72 and 73, as well as return the hydraulic fluid discharged from each of the hydraulic cylinders 54*a*–54*c* to the inside of the hydraulic fluid reservoir 71. In this case, the hydraulic fluid is cyclically supplied at a predetermined flow rate by a gear pump 68, regulators 69 and 70 in accordance with the amount of a paint discharged from the electrostatic coating machine 1.

Further, there are also provided air valves 74*a*–74*d* for supplying driving air to the air cylinders 61*a*–61*d*, and air valves 75*a*–75*m* that output air signals A–C for switching the switching valves 67*a*–67*c* and air signals D–M for turning on an off the air valves 57*a*–57*d*, and 63*a*–63*d* and the color-change valves $CCV_1$–$CCV_5$.

Operation of the Third Embodiment

At first, driving air is supplied from the air valve 74*a* to the air cylinder 61*a* for extending the piston rod 62 of the cylinder, and the male coupler 64 attached to the top end of the piston rod 62 is engaged with the female coupler 58 on the side of the input port 4 of the reciprocal pump 3*a*.

In a case of coating a conductive paint supplied from the paint supply pipe 10*a*, an air signal D is outputted from the air valve 75*d* to the air valves 57*a* and 63*a* for turning both of the air valves 57*a* and 63*a* on, thereby connecting the input port 4 of the reciprocal pump 3*a* with the paint supply pipe 10*a*.

Then, an air signal A is outputted from the air valve 75*a* to the switching valve 67*a* for switching the valve 67*a* such that the hydraulic fluid in the hydraulic fluid reservoir 71 is sent through the pipe 73 to the hydraulic fluid cylinder 54*a*.

Thus, the cylinder 7 of the reciprocal pump 3*a* connected through the insulative shaft 53 to the hydraulic cylinder 54*a* is interlocked to suck and introduce the conductive paint into the inside of the cylinder 7.

In this case, conductive paints each of different color are also introduced previously from the paint supply pipes 10*b* and 10*c* in the same way into the cylinders 7 for the other reciprocal pumps 3*b* and 3*c*, respectively Then, when a predetermined amount of the paint just sufficient for the coating is charged in the cylinder 7 of the reciprocal pump 3*a*, the proximity switch 55 is actuated, and the switch signal causes the air signal A to output from the air valve 75*a* to the air valve 67*a* for switching the valve 67*a* to interrupt driving for the cylinder 7. At the same time, the air signal D is outputted from the air valve 75*d* for turning the air valves 57*a* and 63*a* off. Further, driving air is supplied from the air valve 74*a* to the air cylinder 61*a* for contracting its piston rod 62.

This disengages the paint supply pipe 10*a* from the input port 4 of the reciprocal pump 3*a* again, and the pipe is electrically insulated from the reciprocal pump 3*a*.

Further, the cylinder 7 of the reciprocal pump 3*a* is also electrically insulated from the hydraulic cylinder 54*a* by means of the insulative support 52*a* and the insulative shaft 53 inserted into the inside thereof.

In this state, a high voltage is applied to the electrostatic coating machine 1, an air signal A is outputted from the air valve 75*a* to the switching valve 67*a* for switching the valve 67*a* such that the hydraulic fluid in the hydraulic fluid reservoir 71 is sent through the pipe 72 to the hydraulic cylinder 54*a*. At the same time, an air signal H is outputted from the air valve 75*h* for turning the color change valve $CCV_1$ on, thereby discharging the conductive paint introduced into the cylinder 7 of the reciprocal pump 3*a* from the output port 5 by the power of the hydraulic cylinder 54*a* and supplying the paint at a constant flow rate to the electrostatic coating machine 1. Thus, there is to worry that the high voltage applied to the electrostatic coating machine 1 could cause current leakage to the paint supply systems such as the paint supply pipe 10*a* and troublesome installation of electric insulation means is no more required.

Subsequently, when the coating with the paint supplied from the paint supply pipe 10*a* has been completed, the color-change valve $CCV_1$ is turned off by the air signal H from the air valve 75*h* and the color-change valve $CCV_5$ is turned on by an air signal M from the air valve 75*m* to drive the paint remaining in the manifold 51 of the color-change valve device 50, the paint hose 12 and the electrostatic coating machine 1 out of the coating machine 1 by pressurized air supplied through the cleaning air supply pipe 66. Then, the application of the high voltage to the coating machine 1 is interrupted.

Then, an air signal G is outputted from the air valve 75*g* to the air valves 57*d* and 63*d* for turning both of the valves to on, and driving air is supplied from the air valve 74*d* to the air cylinder 61*d* for extending the piston rod 62 of the air cylinder 61*d*, to engage the male coupler 64' disposed at the top end of the piston rod 62 with the female coupler 60 and connect the cleaning liquid supply pipe 65 with the exclusive cleaning pipe 59.

Next, the color-change valve $CCV_4$ is turned on by the air signal L from the air valve 751 and the inside of the manifold 51, the inside of the paint hose 21 and the inside of the electrostatic coating machine 1 are cleaned with the cleaning liquid supplied from the cleaning liquid supply pipe 65 through the exclusive cleaning line 59. Subsequently, pressurized air is again supplied from the cleaning air supply pipe 66 to drive out the cleaning liquid remaining in the path from the inside of the manifold 51 to the inside of the electrostatic coating machine 1.

After the cleaning has been completed by repeating the above-mentioned procedures for several times, an air signal G is outputted from the air valve 75*g* for turning the air valves 57*d* and 63*d* off, and driving air is supplied from the air valve 74*d* to the air cylinder 61*d* for contracting the piston rod 62 thereof, by which the cleaning liquid supply pipe 65 is disengaged from the exclusive cleaning pipe 59 to electrically insulate both of them from each other.

Accordingly, when the high voltage is applied again to the electrostatic coating machine 1 for starting the coating after the cleaning has been completed, there is no worry that the high voltage could cause current leakage to the cleaning liquid supply systems including the cleaning liquid supply pipe 65 and the like.

In this embodiment, if the cleaning air supply pipe 66 is made of electrically insulative material, there is no worry for the current leakage due to the high voltage, even if it is directly connected with the color-change valve device 50.

Further, since there is no requirement to clean the inside of each of the cylinders 7 of the reciprocal pumps 3*a*–3*c* upon color-change, the time required for color-change can be shortened remarkably, by the remarkable shortening of the cleaning time.

Although each of the cylinders 7 of the reciprocal pumps 3*a*–3*c* for supplying the conductive paint at a predetermined amount to the electrostatic coating machine 1 is driven by respective of the hydraulic cylinders 54*a*–54*c* in this embodiment, the cylinder may be driven also by an air motor or the like by adapting the insulative shaft 53 as the piston rod for the cylinder 7 such that the shaft is moved by a screw-feed mechanism that converts the rotational movement into a linear reciprocal movement.

Further, the reciprocal pumps 3*a*–3*c* are not limited only to the hydraulic cylinders but they may be constituted, for example, as diaphragm pumps. As has been described above according to the present invention, troublesome installation of insulation means to the paint supply systems is not necessary, even when an electroconductive paint such as an aqueous paint is used in electrostatic coating machine applied with a high voltage.

Furthermore, since the multi-color electrostatic coating apparatus according to the present invention is adapted such that installation of insulation means can be saved, not only for the paint supply systems for paints of respective colors, but also for the cleaning liquid supply system and also such that the cleaning time upon color-changeable can be shortened remarkably, it is possible to positively promote the change of coating material for electrostatic coating from insulative resin paints requiring a great amount of deleterious organic solvents, to aqueous paints free from public pollution, which can provide high usefulness in view of the environmental protection.

What is claimed is:

1. An electrostatic coating apparatus for coating a succession of articles each with a selected color of an electroconductive paint, comprising:

an electrostatic coating machine including means for selectively supplying a high voltage thereto, a paint supply pipeline for supplying the electroconductive paint of the selected color from a paint supply connected therewith, to said electrostatic coating machine;

a reciprocal pump interposed in said paint supply pipeline between said electrostatic coating machine and said paint supply pipeline, said reciprocal pump having an input port and an output port and being adapted such that electroconductive paint introduced thereinto from said input port is discharged therefrom at a predetermined flow rate from said output port and supplied in a predetermined amount to said electrostatic coating machine; means detachably connecting said input port of said reciprocal pump with said paint supply pipeline, whereby said reciprocal pump can be provided with sufficient paint to said electrostatic coating machine with sufficient paint to coat an article, while said means for selectively applying a high voltage to said electrostatic coating machine remains unselected, and then said electrostatic coating machine can be disconnected at said detachably connecting means from said paint supply pipeline upstream of said reciprocal pump, so that high voltage can then be selectively applied to said electrostatic coating machine without thereby applying the high voltage to said paint supply pipeline upstream of said reciprocal pump;

a valve device interposed in said paint supply pipeline, between said output port of said reciprocal pump and said electrostatic coating machine;

a drain pipeline connected to said valve device for discharging residual paint remaining in said reciprocal pump;

said valve device being switchable between a painting mode in which said valve device effectively connects said reciprocal pump with said electrostatic coating machine via said paint supply pipeline, and effectively disconnects said drain pipeline from said reciprocal pump, and a cleaning mode in which said valve device effectively connects said reciprocal pump with said drain line and effectively disconnects said reciprocal pump from said electrostatic coating machine;

a color change valve interposed in said paint supply pipeline upstream of said detachable connecting means;

a supply for at least one pressurized cleaning fluid communicated to said color change valve;

said color change valve being operable for alternately:

communicating said paint supply through said paint supply pipeline past said color change valve and isolating said pressurized cleaning fluid supply from downstream of said color change valve, and communicating said pressurized cleaning fluid supply past said color change valve and isolating said paint supply from downstream of said color change valve;

a cleaning fluid pipeline communicated at an upstream end to a second supply of at least one pressurized cleaning fluid and connected to said valve device;

said valve device being further operable for effectively connecting said cleaning fluid pipeline to said electrostatic coating machine only when said valve device is in said cleaning mode;

a respective detachable connection means provided in each of said drain pipeline and said cleaning fluid pipeline, whereby said drain pipeline downstream of the respective said detachable connection means, and said cleaning fluid pipeline upstream of the respective said detachable connection means can be disconnected respectively from said drain pipeline upstream of the respective said detachable connection means and said cleaning fluid pipeline downstream of the respective said detachable connection means ,so that high voltage can be applied to said electrostatic coating machine without thereby applying high voltage to said drain pipeline downstream of the respective said detachable connection means and to said cleaning fluid pipeline upstream of the respective said detachable connection means.

2. An electrostatic coating apparatus for coating an article with an electroconductive paint, comprising:

an electrostatic coating machine applied with a high voltage;

a paint supply pipe connected to said electrostatic coating machine and capable of storing a required amount of the electroconductive paint;

a paint supply pipeline detachably connected to said paint supply pipe for supplying the electroconductive paint into said paint supply pipe;

a cleaning liquid supply pipeline connected to said paint supply pipeline for supplying a cleaning liquid to said paint supply pipe when said pipeline is detached from said supply pipe, said cleaning liquid contacting and forcing the electroconductive paint stored in said paint supply pipe at a predetermined flow rate from said electrostatic coating machine to coat the article; and a cleaning liquid reservoir disposed in an electrically insulated state for supplying the cleaning liquid to said paint supply pipeline.

* * * * *